US009125490B2

(12) United States Patent
Haemmerle et al.

(10) Patent No.: US 9,125,490 B2
(45) **Date of Patent: *Sep. 8, 2015**

(54) ADJUSTMENT DEVICE FOR DRAWER FACEPLATES

(71) Applicant: Julius Blum GmbH, Hochst (AT)

(72) Inventors: Kurt Haemmerle, Lustenau (AT); Andreas Holzer, Dornbirn (AT)

(73) Assignee: JULIUS BLUM GMBH, Hochst (AT)

( * ) Notice: Subject to any disclaimer, the term of this patent is extended or adjusted under 35 U.S.C. 154(b) by 0 days.

This patent is subject to a terminal disclaimer.

(21) Appl. No.: 13/934,919

(22) Filed: Jul. 3, 2013

(65) Prior Publication Data

US 2013/0293078 A1 Nov. 7, 2013

Related U.S. Application Data

(63) Continuation of application No. PCT/AT2011/000514, filed on Dec. 23, 2011.

(30) Foreign Application Priority Data

Jan. 5, 2011 (AT) ..... 15/2011

(51) Int. Cl.
*A47B 88/04* (2006.01)
*A47B 88/00* (2006.01)

(52) U.S. Cl.
CPC ..... *A47B 88/0466* (2013.01); *A47B 88/0055* (2013.01); *A47B 88/0422* (2013.01)

(58) Field of Classification Search
CPC ..... A47B 88/0466; A47B 88/0422; A47B 88/0433; A47B 88/044; A47B 88/0051; A47B 88/0055; A47B 88/0062; A47B 88/007
USPC ..... 312/334.4, 334.5, 330.1, 348.1, 348.2, 312/334.6, 334.1
See application file for complete search history.

(56) References Cited

U.S. PATENT DOCUMENTS 4,874,212 A * 10/1989 Rock et al. ..... 312/330.1
5,002,346 A * 3/1991 Gasser ..... 312/348.4

(Continued)

FOREIGN PATENT DOCUMENTS

AT 509 414 4/2013
CN 101444370 6/2009

(Continued)

OTHER PUBLICATIONS

International Search Report mailed Jun. 1, 2012 in International (PCT) Application No. PCT/AT2011/000514.

(Continued)

*Primary Examiner* — Daniel J Troy
*Assistant Examiner* — Andrew Roersma
(74) *Attorney, Agent, or Firm* — Wenderoth, Lind & Ponack, L.L.P.

(57) ABSTRACT

A device for detachably coupling a drawer to an extendable rail of a pull-out guide including an adjusting device by which a position of a drawer connected to the rail is adjustable relative to the rail in a lateral direction. The adjusting device includes a fastening part that can be fastened to the drawer and a coupling part that can be coupled to the rail. The fastening part is linearly movable by the adjusting device relative to the coupling part, and the adjustment device includes a setting wheel mounted on the coupling part or on the fastening part so as to rotate about an axis. The adjustment device also includes at least two axially spaced transmission devices for converting a rotary movement of the setting wheel into a linear movement of the fastening part relative to the coupling part.

20 Claims, 12 Drawing Sheets

(56) References Cited

U.S. PATENT DOCUMENTS

| | | | | |
|---|---|---|---|---|
| 5,281,022 | A * | 1/1994 | Rock | 312/348.4 |
| 5,664,857 | A * | 9/1997 | Lautenschlager et al. | 312/348.4 |
| 5,860,718 | A * | 1/1999 | Brustle | 312/348.2 |
| 6,913,334 | B2 * | 7/2005 | Weichelt | 312/334.4 |
| 6,945,618 | B2 * | 9/2005 | Kim et al. | 312/334.4 |
| 2004/0239219 | A1 | 12/2004 | Kim et al. | |
| 2007/0138924 | A1 * | 6/2007 | Lautenschlager | 312/348.2 |
| 2008/0247812 | A1 * | 10/2008 | Embacher | 403/231 |
| 2009/0212679 | A1 * | 8/2009 | Frousiakis et al. | 312/334.1 |
| 2009/0251037 | A1 * | 10/2009 | Berger | 312/334.1 |
| 2010/0102692 | A1 * | 4/2010 | Hammerle | 312/348.4 |
| 2012/0292465 | A1 | 11/2012 | Holzer et al. | |
| 2013/0293077 | A1 * | 11/2013 | Haemmerle et al. | 312/319.1 |

FOREIGN PATENT DOCUMENTS

| | | | | |
|---|---|---|---|---|
| CN | 201491999 | | 6/2010 | |
| DE | 94 10 504 | | 11/1994 | |
| DE | 296 00 180 | | 4/1996 | |
| DE | 20 2007 014 9 | | 1/2009 | |
| EP | 1629745 | A1 * | 1/2006 | A47B 88/00 |
| EP | 2064972 | | 6/2009 | |
| WO | 2009/056326 | | 5/2009 | |
| WO | WO2009080403 | A1 * | 7/2009 | A47B 88/00 |
| WO | 2011/094776 | | 8/2011 | |

OTHER PUBLICATIONS

Austrian Search Report dated Oct. 4, 2011 in Austrian Patent Application No. A 15/2011.

Chinese Search Report issued in parallel Chinese Patent Application No. 201180064213.5.

* cited by examiner

ADJUSTMENT DEVICE FOR DRAWER FACEPLATES

BACKGROUND OF THE INVENTION

The invention relates to a device for detachably coupling a drawer to an extendable rail of a pull-out guide.

Such a device is shown in Austrian patent application A 144/2010. By means of the device, the drawer, which is slid over the pull-out guide, can be connected to an extendable rail of the pull-out guide. For this connection, stop surfaces are arranged in the connection region, by means of which an automatic locking engagement of the drawer with the rail of the pull-out guide can take place, a release part being provided by means of which the drawer can be detached again from the rail.

DE 29 600 180 shows a device for detachably coupling a drawer to an extendable rail of a pull-out guide as well as an adjustment device for adjusting the lateral alignment of the rail relative to the drawer. For this purpose, a setting wheel is provided, which via a setting spindle displaces a pin with a hammer-shaped stop surface in the axle direction, wherein by means of the coupling device the blade can either be drawn towards the rail or can be forced away from the rail. Here too the parts moving relative to one another can tilt, as a result of which the adjustment can be complicated.

US 2004/0239219 shows a device for the horizontal and vertical adjustment of a drawer relative to the drawer rail, wherein for the horizontal adjustment an eccentric screw is provided that is mounted in an elongated hole of the extendable rail. In this connection, the horizontal adjustment refers to the longitudinal direction of the pull-out guide.

DE 20 2007 014 954 shows a device that is mounted on the rear part of a pull-out guide and can be secured to the rear wall of the drawer. By a guide device and an operating lever, a vertical adjustment of a drawer connected to the device is possible relative to the rail. For an adjustment in a lateral direction, a setting wheel is provided, which moves a stop plate in the lateral direction. This device does not serve for the detachable coupling of a drawer to an extendable rail of a pull-out guide. In addition adjustment can only be accomplished with difficulty.

By virtue of the fact that the device mentioned in the introduction comprises a fastening part and a coupling part, whose relative position with respect to one another is adjustable by an adjustment device, slight inaccuracies in the manufacture of the pull-out guide or the device, or inaccuracy in the installation in or on the body of an item of furniture, which can lead to the drawer not being able to be extended as desired in the longitudinal direction but being slightly inclined thereto, can be compensated for. In particular, if several drawers are arranged in a furniture body, a smooth clean front appearance of the furniture body relative to the lateral alignment of the drawers can be achieved with such a device.

The adjustment device comprises a setting wheel. By rotating the setting wheel, the fastening part and the coupling part of the device can be adjusted relative to one another. The coupling device itself should have extremely compact dimensions, so that it can be installed on the underneath of the bottom of the drawer without hindering the installation and the moveability of a drawer arranged underneath. For this reason, the structural parts of the coupling device, in particular the adjustment device, are filigree structural parts. If now the lateral position of a drawer connected to the rail is moved by rotating the setting wheel, the contrary moving structural parts of the device may tilt, which complicates the further lateral adjustment.

SUMMARY OF THE INVENTION

The object of the invention is accordingly to avoid the above disadvantages and to improve the manipulation of the device mentioned in the introduction. This object is achieved by a device having the features described below.

The device according to the invention for detachably coupling a drawer to an extendable rail of a pull-out guide allows the drawer as a whole to be installed on or removed from the pull-out guide in the simple manner mentioned in the introduction.

In order to alter the position of a drawer connected to the rail relative to the rail in a lateral direction, for example to correct the overall appearance of a drawer arranged in a furniture body, the device for the detachable coupling comprises a fastening part that can be fastened to the drawer and a coupling part that can be coupled to the drawer. The coupling part and the fastening part are linearly moveable relative to one another and thereby the relative position of the fastening part and coupling part is adjustable relative to one another via an adjustment device provided in the device for the detachable coupling. The adjustment device comprises a setting wheel mounted on the coupling part or on the fastening part so as to rotate about an axis.

In the installation state, in which the drawer is connected to the rail of a pull-out guide, the coupling part of the device serves to connect the drawer to the rail, in that the fastening part of the device is fastened to the drawer and the coupling part is detachably connected to the rail. Due to the adjustability of the relative positions of the fastening part and coupling part with respect to one another, the position of the drawer connected to the rail is adjustable relative to the rail in a lateral direction. The lateral direction in the installation state refers to a horizontal direction transverse to the longitudinal direction in which the drawer is extendable.

In this connection, the fastening part and the coupling part can be moveably guided towards one another, for example by suitably formed stop surfaces, whereby it is ensured that the positional displacement actually takes place in the lateral direction.

The fastening part and the coupling part respectively may also include an installation plate. The installation plate of the fastening device comprises fastening means, e.g. holes for screws, by which the fastening part can be fastened to the drawer. The coupling element itself is mounted on the installation plate of the coupling part, and in the installed state engages with the rail of the pull-out guide. For the relative positional adjustment of the fastening part and coupling part with respect to one another, the adjustment device may displace the positions of the installation plate of the fastening part and the installation plate of the coupling part towards one another in the lateral direction.

The pull-out guide can have a cabinet (body) rail and a drawer rail, wherein the cabinet rail is mounted on the furniture body and the drawer rail is extendable along the cabinet rail. To install the drawer in the furniture body, the drawer is detachably coupled to the drawer rail via the device according to the invention.

In addition, a middle rail can be arranged between the cabinet rail and the drawer rail, which enables the drawer to be extended completely.

Since the adjustment device comprises at least two axially spaced transmission devices for converting a rotational movement of the setting wheel into a linear movement of the fastening part relative to the coupling part, the force transmitted by rotating the setting wheel is relayed via the two axially spaced transmission devices to the fastening part or to the coupling part. In this connection, it may be envisaged that the setting wheel is rotatably mounted on the coupling part and the force is transmitted to the fastening part. It may, however, also be envisaged that the setting wheel is rotatably mounted on the fastening part and a force is transmitted to the coupling part by turning the setting wheel. The distance in the axial direction refers in each case to the axis of rotation of the setting wheel. This axis of rotation may, for example, be aligned substantially parallel to the longitudinal direction of the rail. Due to the axial interspacing, the force for moving the fastening part relative to the coupling part is provided more uniformly, whereby a tilting effect is made more difficult.

In an advantageous embodiment of the invention, the adjustment device is formed so as to be self-locking, so that after an active adjustment of the drawer relative to the extendable rail in the lateral direction an automatic further movement is prevented. This self-locking feature can, for example, be based on a frictional grip of the structural parts of the adjustment device.

In addition or alternatively, an arresting device can be provided, by means of which the relative position of the fastening part and coupling part with respect to one another can be releaseably arrested, and which also serves to ensure that an accidental alteration of the adjusted positions of the fastening part and the coupling part with respect to one another is no longer possible. The arresting device for example includes an eccentric screw exerting a clamping action or also other means.

In an embodiment of the invention, the setting wheel comprises two front faces that respectively engage with one of the devices for converting a rotational movement of the setting wheel into a linear movement of the fastening part relative to the coupling part. For this purpose, suitable means such as stopping surfaces for example and the like may be provided on the front wheel. By rotating the setting wheel, the means can engage with corresponding counter-means on the fastening part or on the coupling part and provide for transmission of a force.

The setting wheel is in principle actuable in both directions and thereby allows the drawer to be adjusted in both directions.

In an embodiment of the invention, the setting wheel is rotatably mounted on the fastening part. The coupling part is linearly moved relative to the fastening part by the adjustment device and for this purpose comprises two devices for converting the rotational movement of the setting wheel into a linear movement. Each of the devices is arranged respectively on a lug of the coupling part.

However, in another embodiment, the setting wheel is rotatably mounted on the coupling part and the fastening part comprises two lugs, on which respectively a transmission device is arranged for converting the rotational movement of the setting wheel into a linear movement.

The transmission devices are in these cases arranged as toothed strips or a similarly shaped toothing arrangement or other stop or holding surfaces on the fastening part or on the coupling part. In an embodiment of the invention, the front faces of the setting wheel are formed as spiral discs, which respectively engage with one of the transmission devices for converting the rotational movement into a linear movement. By a rotation of the setting wheel and thus of the spiral disc, the devices are guided along the setting wheel by for example engagement of the spiral disc with the teeth of the toothed strip giving the positional displacement of the fastening part relative to the coupling part. The spiral disc can in this connection be formed as helical-shape projections, for example on the front faces of the setting wheel, wherein the helical geometry can be configured so that the adjustment device is self-locking when the spiral disc and the device for converting the rotational movement are engaged. The helical geometry of the spiral discs on both front faces of the setting wheel can in this connection be respectively formed so that the correct functioning of the adjustment device is ensured irrespective of the installation direction, i.e. which spiral disc engages with which device. For this purpose, (in other words, the helical-shaped projections) are formed as mirror images on the two front faces.

The setting wheel can include two parts, which respectively engage with one of the devices for converting the rotational movement of the setting wheel into a linear movement when the setting wheel is in the installed state, the two parts being connectable to one another in a rotation-resistant manner. In this connection, on both parts an actuating region for the setting wheel can be respectively arranged, which is characterised for example by an increased roughness or an outer toothed profile, the setting wheel being turned by a rotation of one of the actuating regions. Due to the rotation-resistant connection it is sufficient if only one of the parts of the setting wheel is rotated. The rotational movement is automatically transmitted to the second part, whereby both parts by engagement with the devices convert the rotational movement into a linear movement.

The device can furthermore comprise a housing part, in which an opening is arranged. At least one actuating region of a setting wheel for the rotation thereof projects from the opening, whereby the actuating region is particularly easily accessible.

In an embodiment, of the invention the setting wheel is rotatably mounted about an axis arranged in the installation position substantially parallel to the extension direction of the drawer, i.e. to the longitudinal direction of the rail. The rotational movement of the setting wheel takes place parallel to or parallel to but in an opposite direction to the lateral adjustment direction of the drawer relative to the rail.

Due to the rotatable mounting of the adjustment wheel about an axis arranged in the installation position substantially parallel to the extension direction of the drawer, i.e. to the longitudinal direction of the extendable rail, it is first of all possible in a further embodiment of the invention to take into account the requirements of a low installation height of the device. If the device is mounted on the underneath of a drawer, i.e. on the bottom of the drawer, the adjustment wheel can have an actuating region that is arranged on the underneath of the device. This actuating region, with which the adjustment wheel can be rotated, is provided for example by a roughened covering surface of the setting wheel or by an outer toothed region. The actuating region is in this connection generally that region of the setting wheel that at the moment of actuation is at the greatest distance from the bottom of the drawer.

The actuating region of a setting wheel that in the installation position is rotatably mounted about an axis arranged in the longitudinal direction of the drawer or of the extendable rail, is arranged in the region of the lowest-lying point of the setting wheel, for example in that region that is furthest from the bottom of the drawer, and by a rotation is moved in a lateral direction. The actuating region that is defined by the lowest point of the setting wheel at the respective point in time thus has, during the rotation of the setting wheel, a velocity vector that is aligned substantially in the lateral direction, in other words parallel to or parallel to but in the opposite direction to the front faceplate.

Since in this embodiment the adjustment device comprises a transmission means that converts the movement of the actuating region provided for the rotation of the setting wheel by the adjustment device into a linear movement of the fastening part relative to the coupling part in such a way that the actuating region and the fastening part move in the same direction relative to the coupling part, an intuitive adjustment device is created for the lateral adjustment of the drawer relative to the pull-out guide.

If the direction of rotation of the setting wheel that is actuable in both directions is reversed, in other words the movement direction of the actuating region is changed, then the fastening part also moves in the opposite direction relative to the coupling part. Thus, an adjustment is possible in both lateral directions of the drawer with respect to the extendable rail.

If the fastening part is securely connected to the drawer, while the coupling part is coupled to the extendable rail, this means that with a movement of the actuating region in the direction of the extendable rail, the drawer too moves in this direction, since on account of the transmission device the fastening part moves relative to the coupling part in the same direction as the actuating region of the setting wheel. With a movement of the actuating region in a direction pointing away from the extendable rail, the drawer too moves away from the extendable rail.

In this way, with a lateral adjustment, the setting wheel is automatically rotated in the correct direction. If it is desired to move the drawer to the right with respect to the rail, i.e. with respect to the furniture body, the setting wheel is turned to the right. If it is desired to move the drawer to the left, then the setting wheel is turned to the left.

In principle, various known devices for converting movements, in particular simple gear mechanisms or gear elements, can be used for the transmission device.

The invention furthermore relates to a device set for detachably coupling a drawer to respectively two extendable rails, arranged on opposite sides of a furniture body, of a pull-out guide. The device set includes in this connection a first device for detachably coupling the drawer to the first rail, the first device being designed as described above. A second device for detachably coupling the drawer to the second rail serves to couple the drawer on both its sides to the corresponding extendable rails of a pull-out guide. The pull-out guides to be arranged on both sides of the drawer can in this connection each include a cabinet rail and a drawer rail. A middle rail can be arranged between the cabinet rail and the drawer rail. The two devices are correspondingly mounted on both sides of the drawer, and it is preferably to arrange the devices in the front region, i.e. in the region of the front faceplate.

It may be possible that only the first device comprises an adjustment device for the relative positional displacement of the fastening part and the coupling part. In order that the drawer is nevertheless displaceable relative to the rail in the lateral direction, the second device for the detachable coupling is in a corresponding manner also formed to be partially moveable. The second device comprises a second fastening part fastenable to the drawer and a second coupling part that can be coupled to the rail. The second fastening part and the second coupling part are linearly moveably mounted relative to one another so as to adapt to the relative positional displacement of the fastening part and the coupling part of the first device.

The second coupling part and the second fastening part can in a first embodiment be mounted in a floating manner relative to one another. If the relative position of the fastening part and coupling part of the first device is adjusted by the adjustment device, this leads to a co-movement of the second fastening part or of the second coupling part, so that their relative position is also displaced.

The second device can in this connection be designed and constructed substantially like the first device except for the adjustment device, which in contrast to the first device is not present.

In a further embodiment, it is however also possible to provide the second device with an adjustment device, by means of which a position of the drawer connected to the second rail can be adjusted relative to the second rail in a lateral direction. The second adjustment device comprises a second setting wheel rotatably mounted about an axis on a second coupling part or on the second fastening part. In addition, at least two axially spaced devices are provided for converting a rotational movement of the second setting wheel into a linear movement of the second fastening part relative to the second coupling part. The second adjustment device can in this case be constructed substantially identically to the first adjustment device and can have the same features.

In a further embodiment, the second setting wheel can be rotatably mounted about an axis arranged in the installation position substantially parallel to the extension direction of the drawer, and on the second setting wheel there is provided a second actuating region for rotating the second setting wheel. In addition, the second adjustment device includes a second transmission device, wherein by means of this device a movement of the second actuating region of the second setting wheel can be converted into a linear movement of the second fastening part relative to the second coupling part in the same direction. The second transmission device accordingly has the same purpose and the same mode of action as the transmission device for the first device mentioned above. The spiral disc(s) of the second setting wheel is or are in this connection formed as mirror images of the spiral disc(s) of the setting wheel. In particular, if the setting wheel itself comprises two spiral discs formed as mirror images, an identical setting wheel can be used as second setting wheel. It may furthermore be envisaged that the second adjustment device also comprises at least two axially spaced second devices for converting a rotational movement of the second setting wheel into a linear movement of the second fastening part relative to the second coupling part.

In one embodiment, the second adjustment device is designed to be self-locking, and in addition or alternatively comprises an arresting device by means of which the relative position of the second fastening part and of the second coupling part with respect to one another can be releaseably arrested.

The invention furthermore relates to a drawer with a device as described above or with a device set as described above fastened to the drawer. The invention in addition relates to an item of furniture with at least one such drawer.

BRIEF DESCRIPTION OF THE DRAWINGS

Further details and advantages of the present invention are described in more detail hereinafter with the aid of the description of the drawings and with reference to the accompanying drawings, in which.

DETAILED DESCRIPTION OF THE INVENTION

Figure 1:
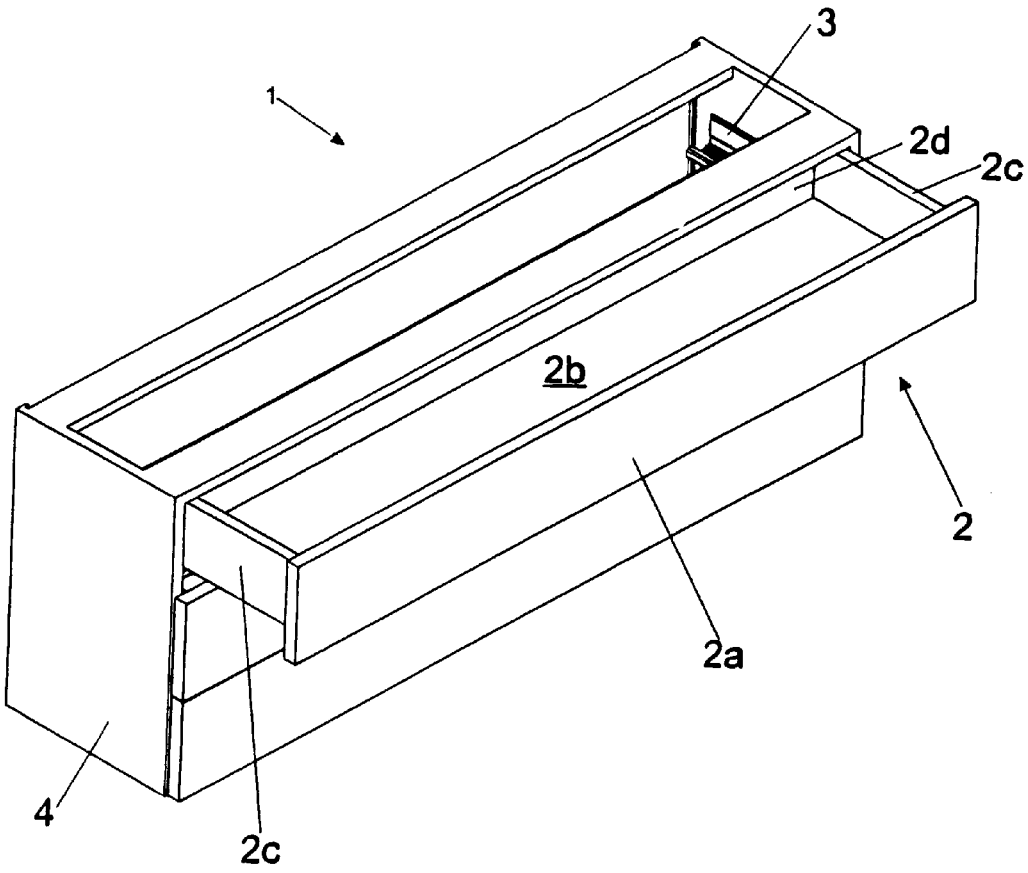
FIG. 1 is a partially open perspective view of an item of furniture according to the invention.

The partially open perspective view of FIG. 1 shows an item of furniture 1 with a plurality of extendable drawers 2 arranged in a furniture body 4, which are installed in the furniture 4 body via respectively two pull-out guides 3 arranged on opposite sides of the furniture body 4. The pull-out guides 3 are arranged on opposite side walls 2*c* of the drawer 2. The drawer 2 has on its front side a front faceplate 2*a* and on its rear side a drawer rear wall 2*d*. The bottom of the drawer 2*b* is arranged therebetween.

Figure 2B:
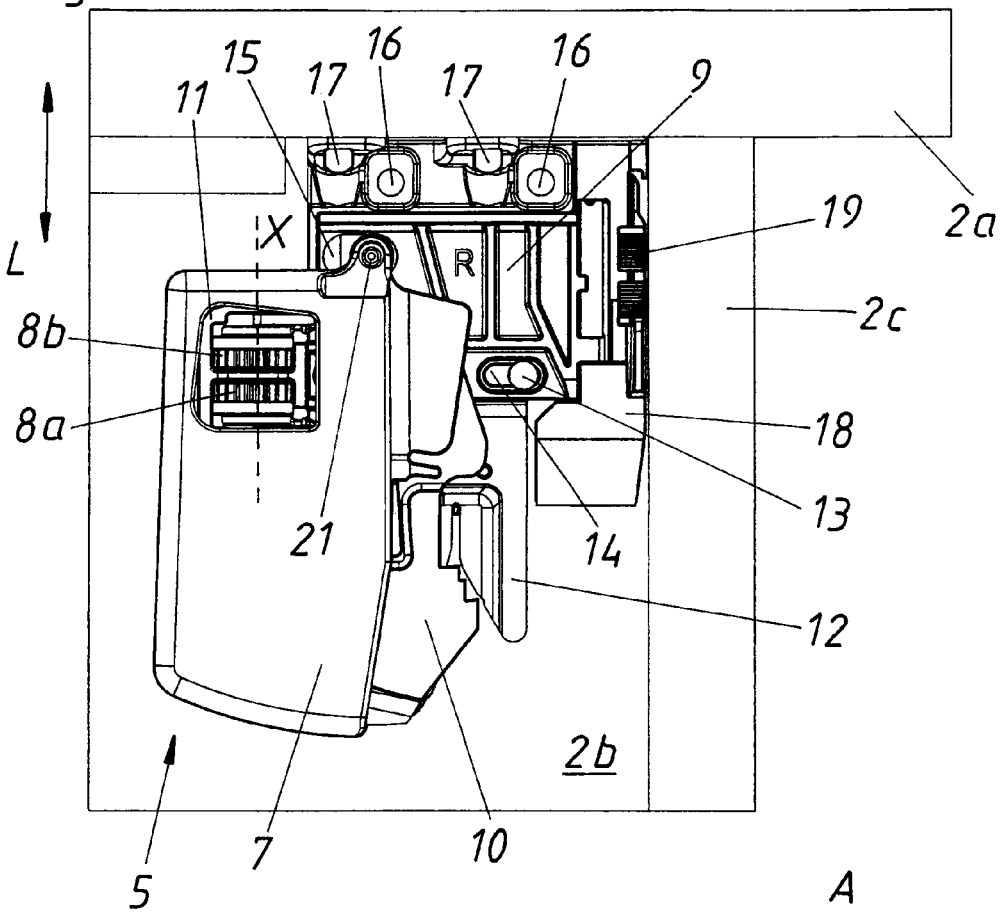
FIGS. 2*a* and 2*b* are perspective views of the bottom of the drawer with a device set as well as a view from below of a device according to the invention on a drawer in a first operating position.
Figure 2A:
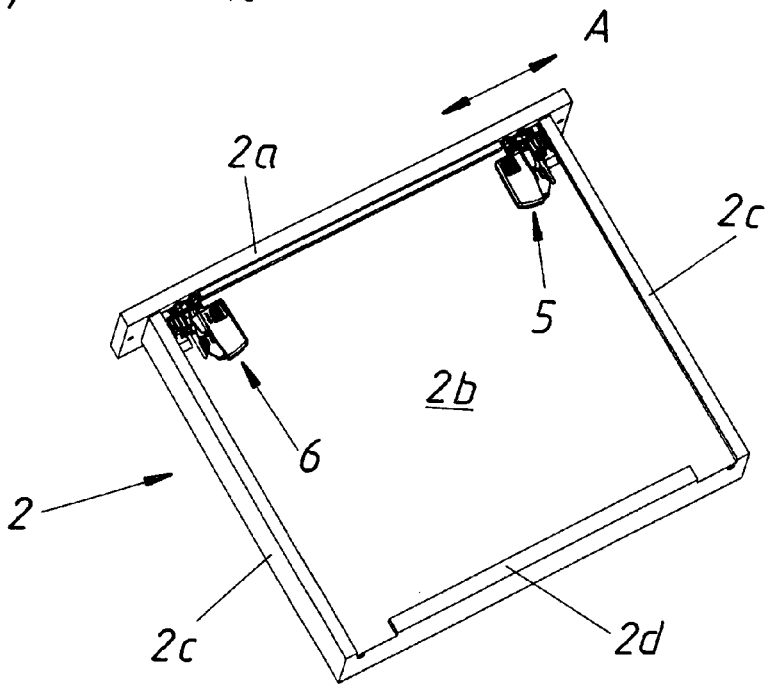

FIG. 2*a* shows a drawer 2 from below, which on opposite side walls 2*c* is coupled to a pull-out guide 3 via a first coupling device 5 and a second coupling device 6. For the sake of clarity, the pull-out guides, which are known per se in the prior art, are not illustrated in this figure. The pull-out guides 3 each include a body rail 3*c*, 35*c*, which are fastened to the furniture body 4, which is also not shown in this figure. The drawer 2 is thereby coupled via a device set according to the invention to the two pull-out guides 3 fastened on opposite sides of the furniture body 4. The two coupling devices 5, 6 for the detachable coupling to the rail 3*a* of a pull-out guide 3 are arranged on the front end of the bottom of the drawer 2*d* located in the region of the front faceplate 2*a*. Both coupling devices 5, 6 each comprise an adjustment device, which permits via a setting wheel 8 a lateral displacement in the direction of the double arrow A of the drawer 2 relative to the pull-out guide 3. The coupling devices 5, 6 can be designed in such a way that an adjustment on one side of the drawer 2 is transferred to the adjustment device located on the other side.

FIG. 2*b* is a detailed view of the first device 5 together with a section of the drawer 2. The mode of operation for the detachable coupling of the drawer 2 to a pull-out guide 3 takes place in a similar way as described in Austrian application A 144/2010. A resilient or spring-loaded catch part 10 can in the course of the installation process lockingly engage automatically with a rail 3*a* of a pull-out guide 3. In order to release the locking engagement, a release part 7 in the form of a manually operated swivel lever is provided, so that the coupling between the coupling device 5 and the extendable rail 3*a* of the pull-out guide 3 can be released. The pull-out guide 3 is again for the sake of clarity not shown in this figure.

Figure 5:
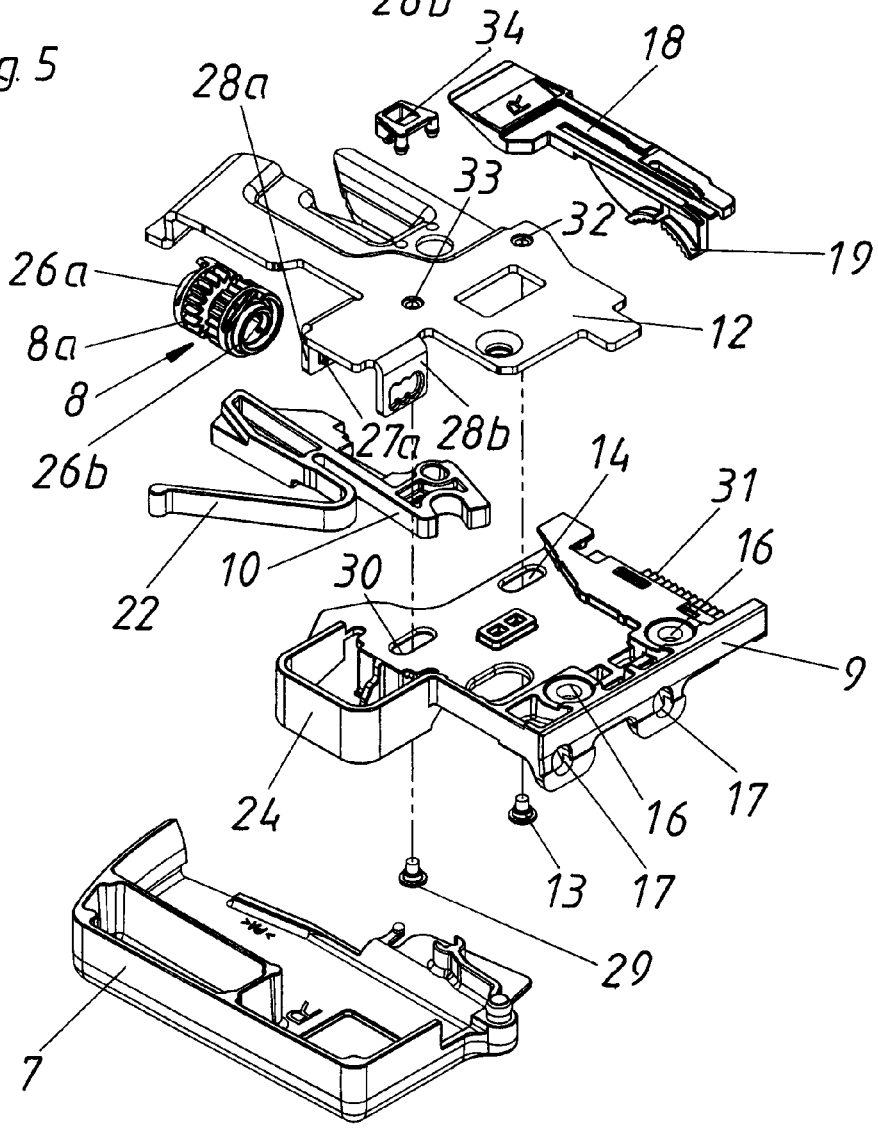
FIG. 5 is an exploded representation of a device according to the invention.

The release part 7 has a housing opening 11. The region of the setting wheel 8 (consisting of two halves 8*a*, 8*b* forming a cylindrically-shaped body, as shown in FIG. 5) projecting from the opening 11 forms the actuating region 37 serving to rotate the setting wheel 8. The outer surfaces of the halves 8*a*, 8*b* comprise for this purpose a toothed actuating region, so that the setting wheel 8 can easily be rotated manually. Both halves 8*a*, 8*b* of the setting wheel 8 are rotatably mounted on the fastening part 9 about an axis X arranged parallel to the bottom of the drawer 2*b* in the longitudinal direction L of the side walls 2*c*. The fastening part 9 comprises fastening holes 16 for fixing the fastening part 9 to the bottom of the drawer 2*b*, and fastening holes 17 for fixing the fastening part 9 to the front faceplate 2*a*. The coupling part 12 includes inter alia the catch part 10 as well as the release part 7. The axis X represented by the dotted line, about which the setting wheel 8 is rotatably mounted in the installation position, is aligned substantially parallel to the longitudinal direction L, represented by the double arrow L, of the detachable rail 3*a* and the drawer 2. The regions of the two halves 8*a*, 8*b* of the setting wheel respectively projecting from the opening 11 serve as the actuating region 37 for the rotation of the setting wheel 8.

The setting wheel 8 of the adjustment device engages by via the two halves 8*a*, 8*b* respectively with transmission devices 28*a*, 28*b* having toothed strip portions 27*a*, 27*b* of the adjustment device for converting a rotational movement of the setting wheel 8 into a linear movement of the coupling part 12 relative to the fastening part 9. In other words, a rotation of the setting wheel 8 is converted into a linear movement of the coupling part 12 relative to the fastening part 9. In this connection, the fastening part 9 or the coupling part 12 can be actively moved, depending on which of these parts the setting wheel 8 is mounted.

To guide the movement, the coupling part 12 has a guide pin 13, which is guided in an elongated hole 14 of the fastening part 9. The bearing 21 of the release part 7 is arranged in a further elongated hole 15 of the fastening part 9, and likewise serves to guide the linear movement. The fastening part 9 is located relative to the coupling part 12 in the illustrated figure in a first operating position.

Since the fastening part 9 is fixed to the drawer and the coupling part 12 is connected in the installed state to the extendable rail 3*a*, the relative movement between the fastening part 9 and coupling part 12 will result in a relative movement between the extendable rail 3*a* and drawer 2. An adjustment element 18 with a handle 19 is displaceably mounted in the fastening part 9 in the longitudinal direction of the side wall 2*c* and serves for the height adjustment of the drawer 2 relative to the pull-out guide 3*a*, as is known per se in the prior art.

The second coupling device 6, which is arranged on the side of the drawer 2 opposite the first device 5, can in this connection be formed in substantially the same way as the first device 5.

Figure 3:
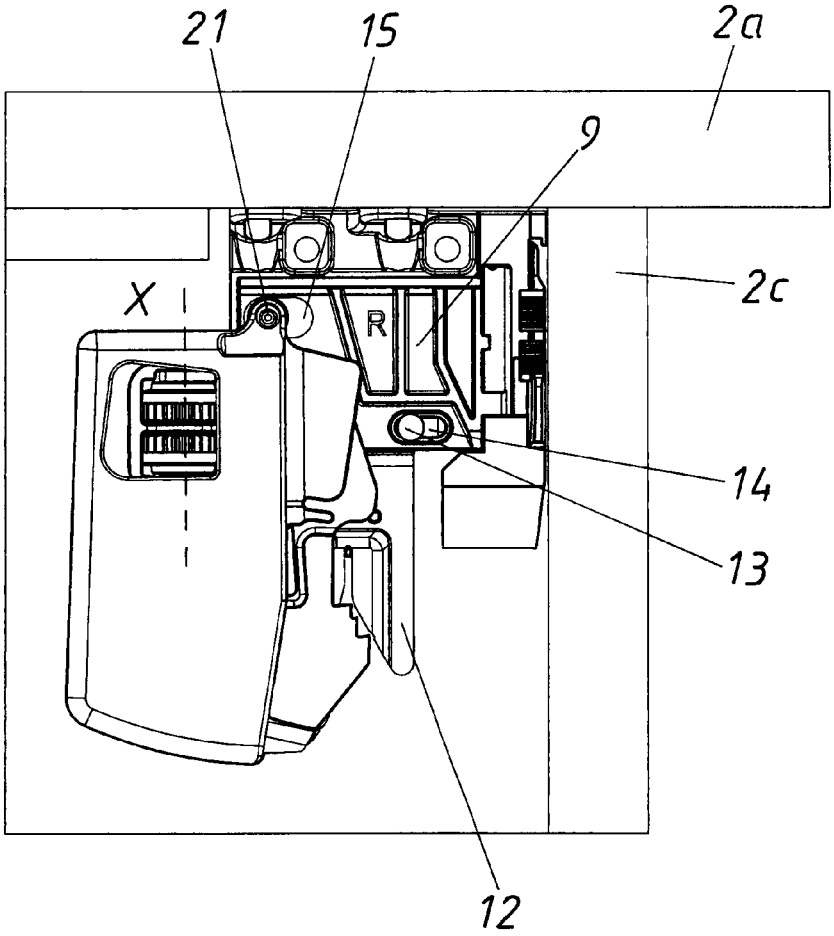
FIG. 3 is a view from below of a device according to the invention on a drawer in a second operating position.

FIG. 3 shows the arrangement of FIG. 2*b*, with the difference being that due to a rotation of the setting wheel 8, the coupling part 12 has moved compared to the fastening part 9 in a direction pointing away from the illustrated side wall 2*c*. The device has been moved into a second operating position, there being no restrictions on the two illustrated operating positions. The relative displacement of the fastening part 9 to the coupling part 12 can be seen with the aid of the guide pin 13. In contrast to FIG. 2*a*, the guide pin 13 in FIG. 3 is located in the region of the left-hand end of the elongated hole 14. The same applies to the bearing position 21 in the elongated hole 15. The extendable rail 3*a* (not illustrated in this figure) is in the installed stated connected to the coupling part 12, so that with the coupling part 12, the rail 3*a* too has been laterally displaced relative to the fastening part 9 and thus to the drawer 2.

Figure 4A:
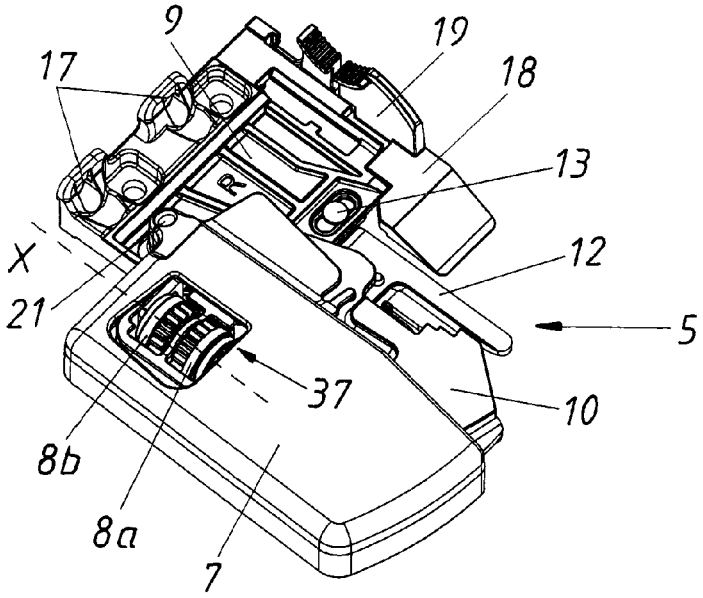
FIGS. 4*a* to 4*d* are a perspective view and a partially open perspective view of a device according to the invention together with a detailed view as well as a further perspective view of the device.

FIG. 4*a* shows the coupling device 5 in a perspective view. The coupling device 5 together with its structural parts thus corresponds to the embodiment shown in FIG. 2*b*. It can be seen that sections of the two halves 8*a*, 8*b* of the setting wheel 8 project from the opening 11 (i.e. protrude above the surface of the release part 7). These aforementioned regions serve as actuating region 37.

Figure 4B:
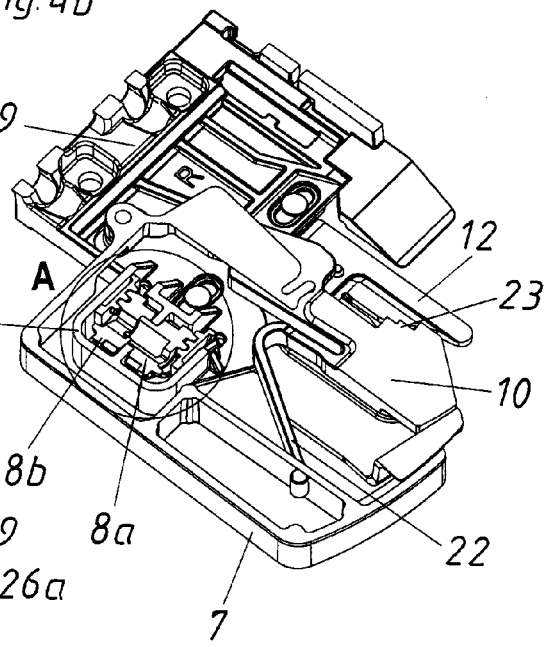

FIG. 4*b* shows the coupling device 5 of FIG. 4*a* in a partially open representation. It can be seen that the catch part 10 has step-shaped stop surfaces 23, which in a manner known per se can be brought to abut against an edge of a recess in the extendable rail 3*a*, the stop surfaces 23 being arranged staggered with respect to one another in the extension direction of the drawer. Thus, a sequential locking engagement of the catch part 10 on the extendable rail 3*a* becomes possible. The catch part 10 is in this connection resiliently mounted via a bendable strut 22. The coupled state of the catch part 10 is released by the release part 7.

Figure 4C:
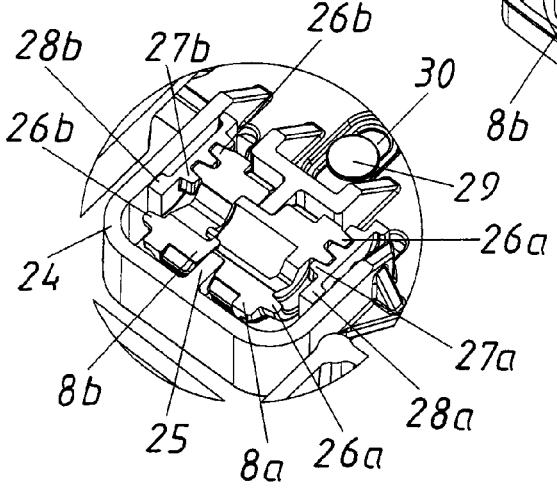

The detailed view illustrated in FIG. 4*c* of the section of FIG. 4*b* identified by A shows an open representation of the adjustment device. The fastening part 9 comprises an enclosed housing 24 in which the adjustment device is arranged. The setting wheel 8 of the adjustment device has two halves 8*a*, 8*b*, which are connected to one another in a rotation-resistant manner and are rotatably mounted about an axis on a web 25 of the enclosed housing 24. In the installation state of the device 5, this axis is arranged substantially in the longitudinal direction of the side wall 2*c* of the drawer 2 and of the pull-out guide 3.

Output drive portions in the form of spiral disc 26*a* and 26*b* is arranged on front sides of the halves 8*a*, 8*b* of the setting wheel 8, i.e. the front sides comprise respectively helical-shaped projections (output drive portions). The spiral discs 26*a*, 26*b*, i.e. the helical-shaped projections, engage in the toothed strip portions 27*a*, 27*b*. The toothed strip portions (toothed strips) 27*a*, 27*b* are arranged respectively on lugs 28*a* and 28*b*, which in turn are arranged on the coupling part 12. The lugs 28*a*, 28*b* and the coupling part 12 can be formed as one part. A rotation of one of the halves 8*a*, 8*b* of the setting wheel 8 is, due to the rotation-resistant connection, transmitted automatically to the respective other half. The spiral discs 26*a* and 26*b* engage with the toothed strips 27*a* and 27*b*, so that due to the rotation of the setting wheel 8, the helical-shaped projections of the spiral discs 26*a*, 26*b* are guided along on the teeth of the toothed strips 27*a*, 27*b*, resulting in a relative positional displacement of the lugs 28*a*, 28*b* with respect to the enclosed housing 24. Since the enclosed housing 24 is securely connected to the fastening part 9, and the lugs 28*a*, 28*b* are securely connected to the coupling part 12, there is therefore a conversion of the rotational movement of the setting wheel 8 into a linear movement of the fastening part 9 relative to the coupling part 12. The lugs 28*a*, 28*b* thus serve together with the toothed strips 27*a*, 27*b* as transmission devices 28*a*, 28*b* according to the invention for converting the rotational movement. A further elongated hole 30 arranged in the fastening part 9 can also be seen, in which a guide pin 29 of the coupling part 12 is displaceably guided and likewise serves to guide the movement.

Figure 4D:
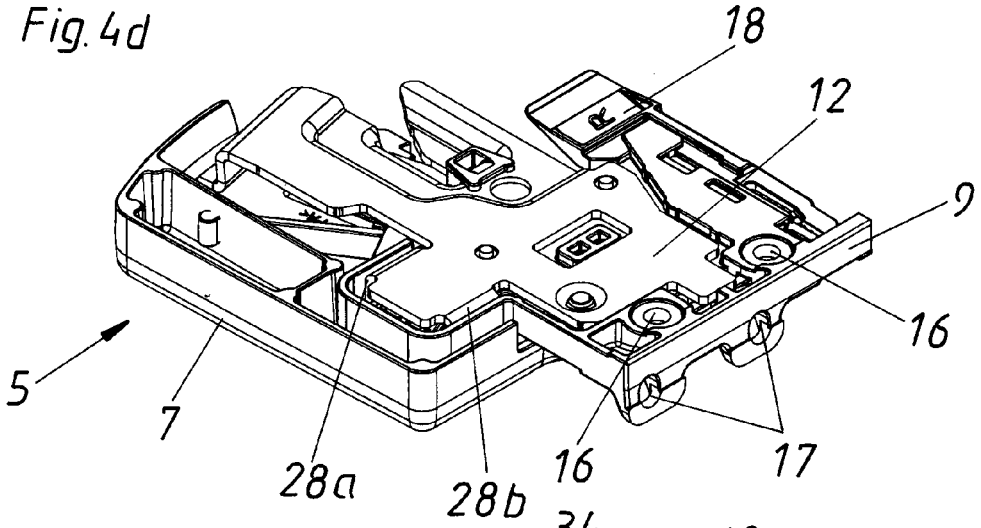

FIG. 4*d* shows the coupling device 5 in a perspective view from below. It can be seen that the lugs 28*a*, 28*b* are formed as curved stop surfaces of the coupling part 12 and in this case are therefore fabricated in one piece with the coupling part 12.

FIG. 5 shows an exploded representation of the structural parts of the coupling device 5. The lugs 28*a* and 28*b* arranged on the coupling part 9 can be recognized, on the inside of each of the lugs is respectively arranged a toothed strip portions 27*a*, 27*b* (which form the transmission devices 28*a*, 28*b*), which can be brought into engagement with helical-shaped projections in the form of a spiral disc 26*a*, 26*b* on each of the two halves 8*a*, 8*b* of the setting wheel 8, which are connected to one another in a rotation-resistant manner. The fastening part 9, which is mounted on the drawer 2 via fastening holes 16, 17, has a further toothed section 31 that can be brought into engagement with the adjustment element 18 for adjusting the height. The enclosed housing 24 formed on the fastening part 9 can also be seen. As can be recognized with the aid of the dotted lines, the guide pins 13 and 29, which are inserted into bores 32 and 33 of the coupling part 12, serve to connect the fastening part 9 to the coupling part 12. Since the guide pins 13 and 29 are inserted into the elongated holes 14 and 30 of the fastening part 9, there is a restricted linear moveability of the fastening part 9 relative to the coupling part 12. The elastically compliant material piece 34 serves to compensate a length difference when the extendable rail 3*a* is engaged with the coupling part 12.

Figure 6A:
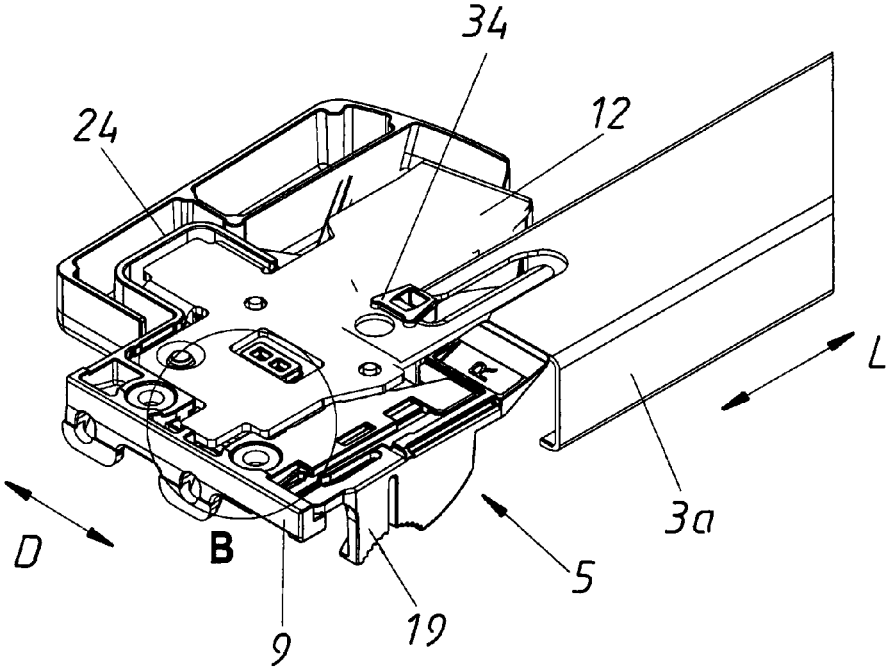
FIGS. 6*a* and 6*b* are a perspective view of a device according to the invention arranged on a pull-out guide in the first operating position as well as a detailed view thereof.

FIG. 6*a* shows in a perspective view the coupling device 5 connected to an extendable rail 3*a*. Due to the setting wheel 8, the coupling part 12 and thus the extendable rail 3*a* connected thereto can be moved relative to the fastening part 9 and thus to the drawer 2 connected thereto, in the direction of the double arrow D.

Figure 6B:
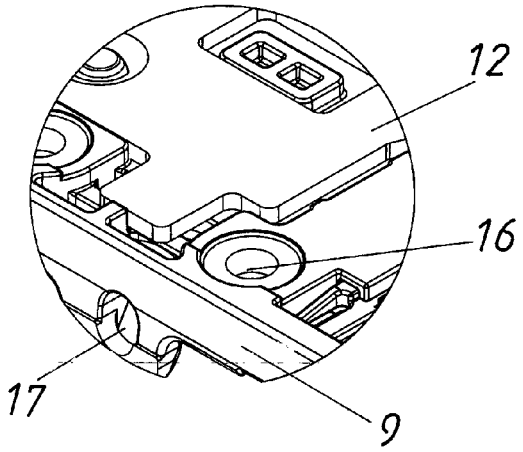

FIG. 6*b* shows in a detailed view the section of FIG. 6*a* identified by B. The coupling part 12 and fastening part 9 are in a first operating position.

Figure 7A:
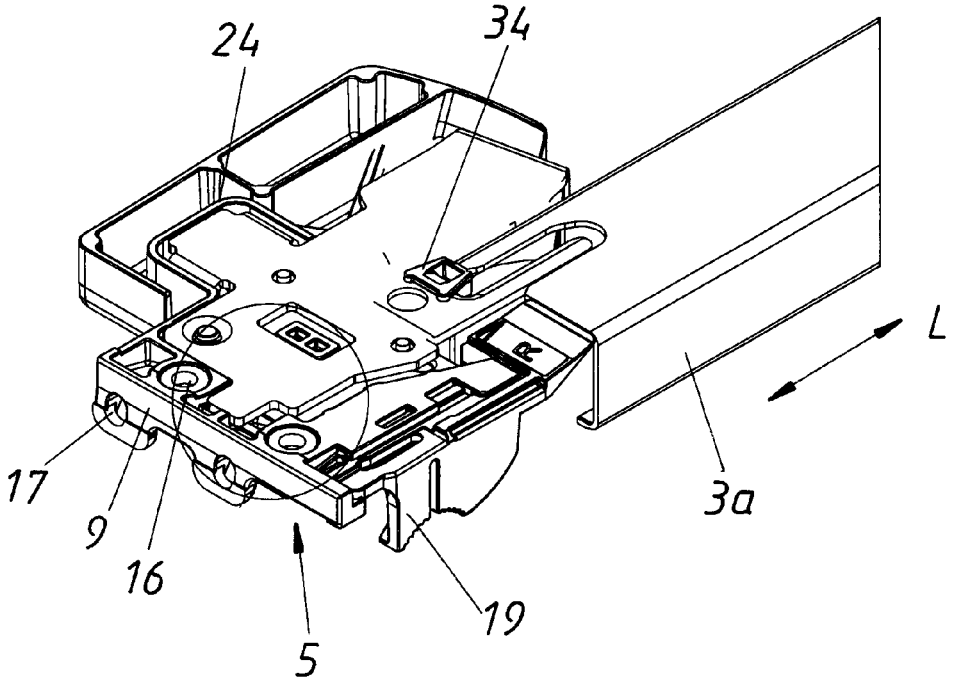
FIGS. 7*a* and 7*b* are a perspective view of a device according to the invention arranged on a pull-out guide in a second operating position as well as a detailed view thereof.
Figure 7B:
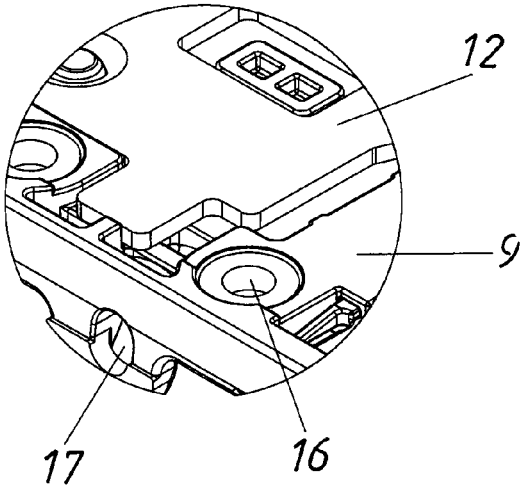

FIGS. 7*a* and 7*b* differ from FIGS. 6*a* and 6*b* in that the coupling part 12 is located in a second operating position relative to the fastening part 9. In other words, the coupling part 12 together with the connected extendable rail 3*a* has compared to FIGS. 6*a* and 6*b* been linearly displaced relative to the fastening part 9.

Figure 8B:
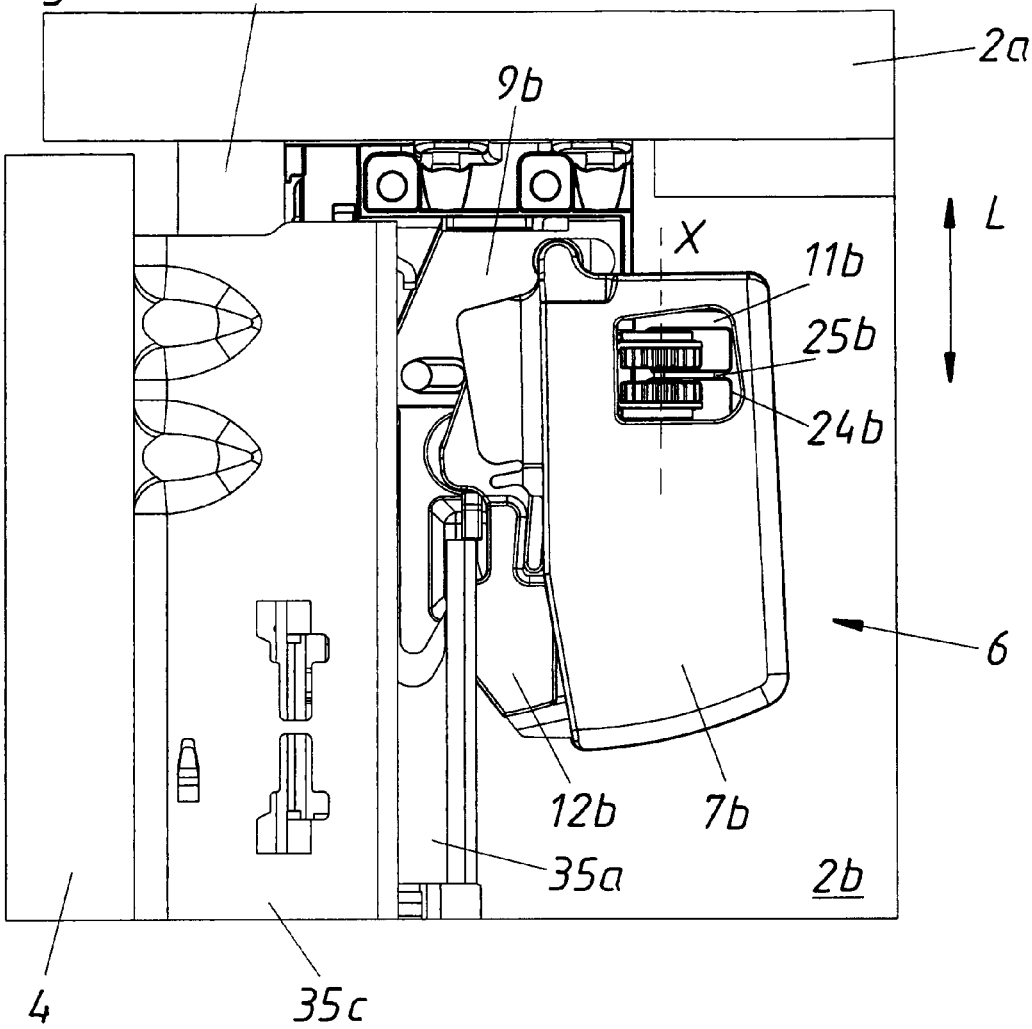
FIGS. 8*a* and 8*b* are a perspective view of the bottom of a drawer with a device set according to the invention and a view from below of a device according to the invention in a first operating position.
Figure 8A:
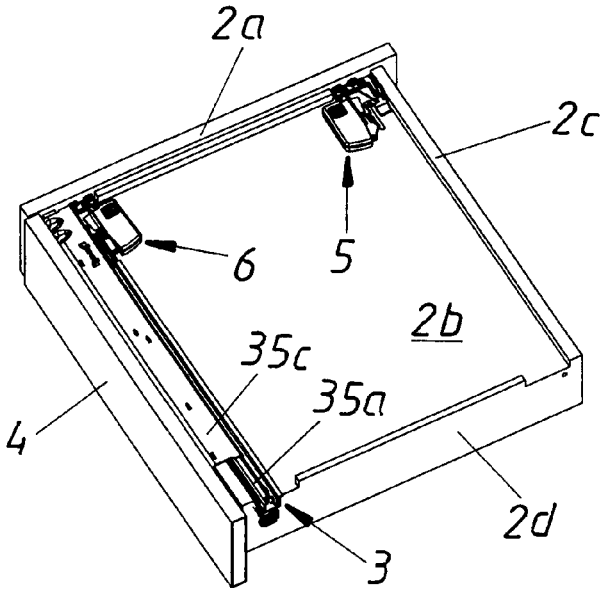

FIG. 8*a* shows in a perspective view a drawer 2 from below, wherein a pull-out guide 3 is illustrated on a side wall 2*c* of the drawer 2. For the sake of clarity, no pull-out guide 3 is illustrated on the opposite wall 2*c*. A second coupling device 6 lying opposite a first device 5 for the detachable coupling of a drawer 2 to an extendable rail 3*a* of a pull-out guide 3, which second coupling device likewise serves for the detachable coupling, is illustrated in the state coupled to the extendable rail 35*a*. In addition, on each side of the drawer 2 on which the pull-out guide 3 is illustrated, a region of the furniture body 4 is shown, to which is fastened the body rail 35*c* of the pull-out guide 3.

FIG. 8*b* shows a detailed view of the second device 6 as well as the region of the drawer 2 and of the furniture body 4. The body rail 35 is fixed to the furniture body 4. The extendable rail 35*a* moveable relative to the furniture rail 35*c* engages with the second coupling device 6, so that the drawer 2 as a whole is coupled to the pull-out guide 3. In some cases, a middle rail moveably mounted between the body rail 35*c* and extendable rail 35*a* can be provided. The second coupling device 6 has substantially the same structural parts as the first coupling device 5, with the proviso that the second coupling device 6 has to be arranged on a side of the drawer 2 opposite to the first coupling device 5. Therefore, for example, the release part 7*b* of the second coupling device 6 viewed from below is rotated about the bearing position 21*b* in a clockwise direction in order to release the drawer 2 from the extendable rail 35*a*, while the release part 7 of the first coupling device 5 is rotated in a counter-clockwise direction about the bearing site 21 in order to release the coupling. In other words, some of the structural parts of the second coupling device 6 are therefore formed as mirror images of the corresponding structural parts of the first device 5, even though they perform the same function. The second coupling device 6 thus comprises like the first coupling device 5 a setting wheel, which consists of two securely connectable halves 36*a* and 36*b*, and by means of which the second fastening part 9*b* is linearly moveable relative to the coupling part 12. In this way, a lateral adjustment of the drawer 2 relative to the pull-out guide 3 is made possible. The second setting wheel is rotatably mounted on a web 25*b* of an enclosed housing 24*b*, and a second actuating region protrudes from a housing opening 11*b* and projects beyond the release part 7*b*.

There can also be recognized the longitudinal direction L of the drawer 2, which corresponds to the longitudinal direction L of the extendable rail 35*a* as well as of the extendable rail 3*a*, and the axis X arranged substantially parallel to this longitudinal direction L, about which the two halves 36*a*, 36*b* of the second setting wheel are rotatably mounted.

If an adjustment in the lateral direction is made on the first coupling device 5, this movement is transferred to the second device 6, so that also with the latter the second fastening part 9*b* moves relative to the second coupling part 12*b*. It can also be seen that the overall appearance of the drawer 2 arranged in the furniture body 4 is not optimal, since there is a large lateral distance from the front faceplate 2*a* to the outer wall of the furniture body 4.

Figure 9B:
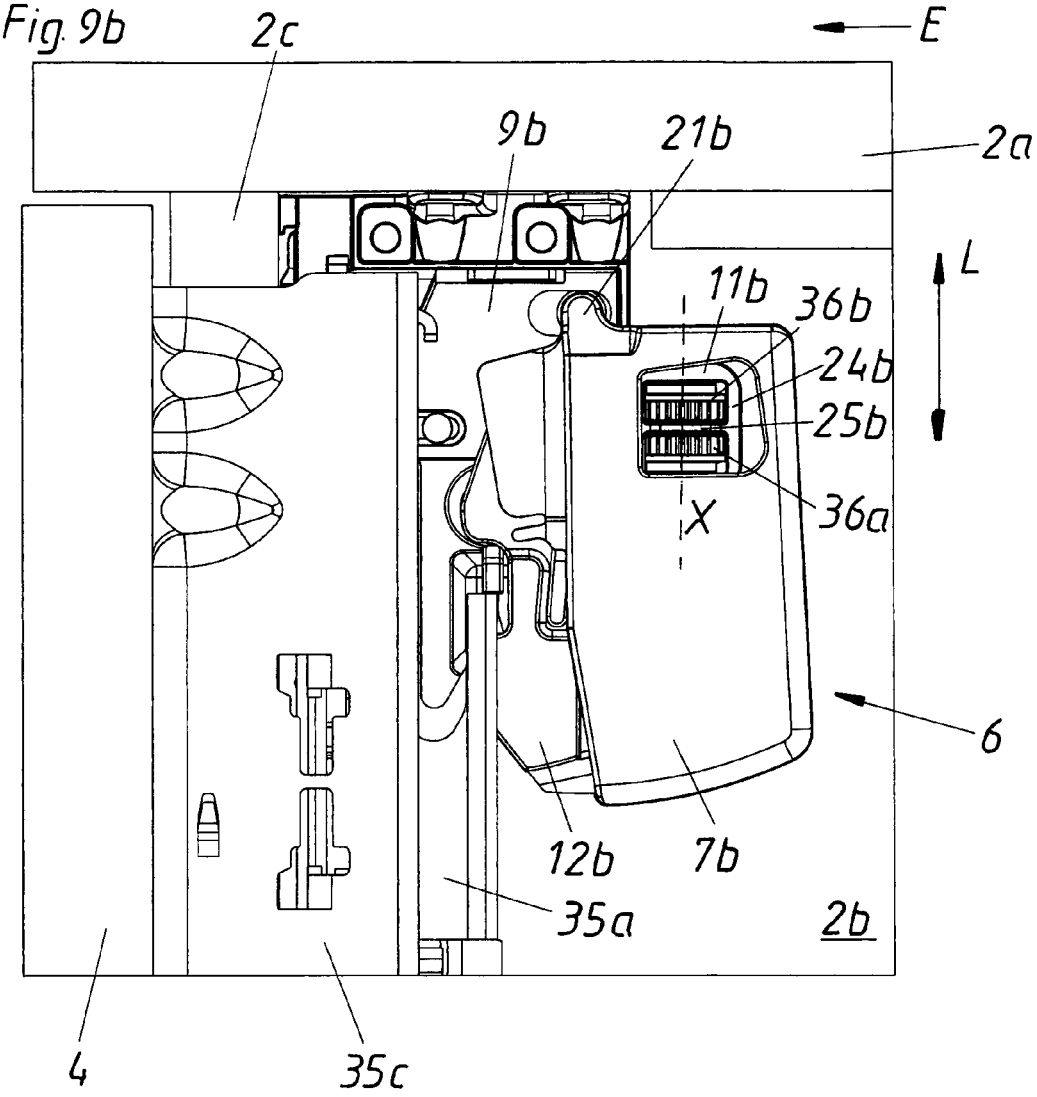
FIGS. 9*a* and 9*b* are a perspective view of the bottom of a drawer with a device set according to the invention and a view from below of a device according to the invention in a second operating position.
Figure 9A:
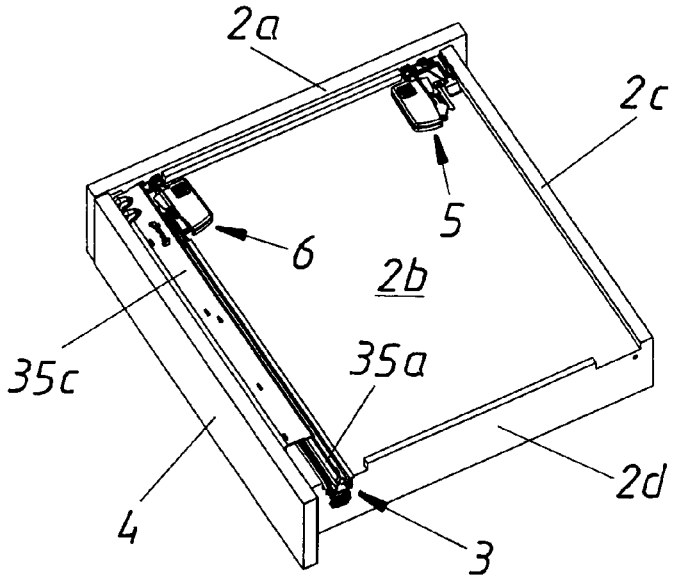

FIGS. 9*a* and 9*b* show the same arrangement as FIGS. 8*a* and 8*b*, except that due to a rotation of the actuating region of the setting wheel 8 or of the second setting wheel, the drawer 2 together with the front faceplate 2*a* has been moved in the direction of the arrow E relative to the pull-out guide 3 and therefore relative to the furniture body 4. The overall appearance is significantly cleaner, since the lateral distance from the front faceplate 2*a* to the outer wall of the furniture body 4 is significantly less.

Figure 10A:
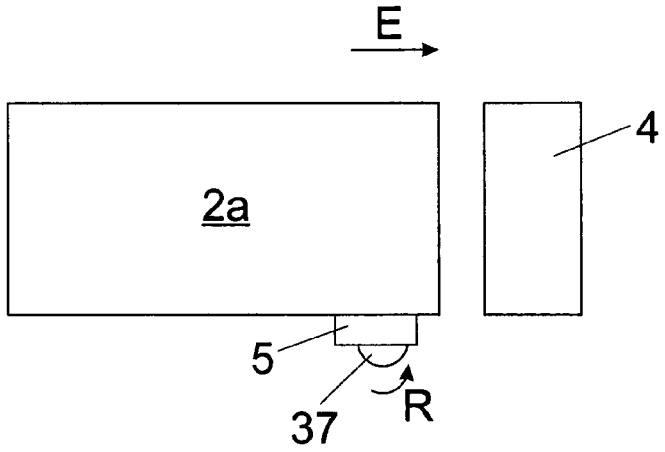
FIGS. 10*a* and 10*b* are schematic representations of the functional principle of a device according to the invention.

FIG. 10*a* shows for the schematic illustration of the functional principle of the invention a schematic view of a drawer 2 from the front, which is arranged in a furniture body 4 and is provided with a coupling device 5. Only one side wall of the furniture body 4 is illustrated. The dimensional relationships of this illustration do not correspond to reality, but are chosen only for illustrative purposes. The actuating region 37 of the setting wheel 8 projecting downwardly from the housing provides its rotation.

With the coupling device 5, the drawer 2 and therefore also the front faceplate connected to the drawer 2 can be displaced in a lateral direction with regard to the extendable rail 3*a*. Since the extendable rail 3*a* is moveably mounted in a body rail 3*c*, which in turn is arranged on the side wall of the furniture body 4, a lateral displacement of the front faceplate 2*a* with respect to the furniture body 4 is effected by the device 5. A clean joint image can therefore be produced with the coupling device 5. The structural parts of the pull-out guide 3 are not shown for the sake of clarity.

By a rotation of the setting wheel 8 in a first rotational direction R, a lateral displacement of the front faceplate 2*a* occurs in the direction E towards the side wall of the furniture body 4. The movement of the actuating region 37 occurs in this connection at the lowest region of the setting wheel 8. In this regard, the tangential component of the first rotational direction R applied there coincides with the direction E. In other words, a movement of the actuating region 37 coincides with the direction E of the movement of the front faceplate 2*a* relative to the furniture body 4. Since the front faceplate 2*a* is securely connected to the fastening part 9, and the furniture body 4 is coupled via the body rail 3*c* and the extendable rail 3*a* to the coupling part 12, the movement of the actuating region 37 also coincides with the movement of the fastening part 9 relative to the coupling part 12.

Figure 10B:
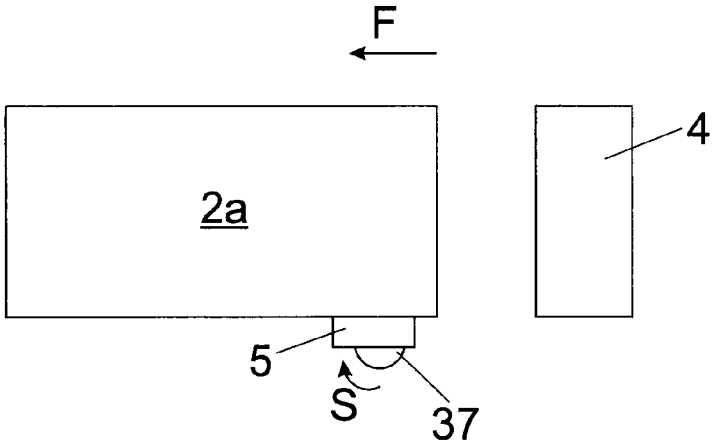

In FIG. 10*b*, the setting wheel 8 is turned in a second rotational direction S, for which purpose a movement of the actuating region 37 again takes place at the lowest end of the setting wheel 8, in this case in the opposite direction to the direction discussed in connection with FIG. 10. Here, too, the movement of the actuating region 37 coincides with the direction F of the lateral displacement of the front faceplate 2*a* relative to the furniture body 4, which in this case is displaced away from the side wall of the furniture body 4. Since the front faceplate 2*a* is securely connected to the fastening part 9 and the furniture body 4 is coupled via the body rail 3*c* and the extendable rail 3*a* to the coupling part 12, in this case too the movement of the actuating region 37 also coincides with the movement of the fastening part 9 relative to the coupling part 12.

It can be seen from FIGS. 10*a* and 10*b* that, according to the invention, an intuitively particularly simple adjustment possibility has been created by the coupling device 5. In order to allow this correspondence in the movement directions, the transmission device 28*a*, 28*b* engaging spiral discs 26*a*, 26*b* on the front sides of the setting wheel 8 that is employed in one embodiment of the invention has a corresponding curvature sign. If on the other hand the sign of the curvature is altered, i.e. a spiral disc 26*a*, 26*b* is chosen with differently "wound" helical-shaped projections, then the movement direction of the fastening part 9 relative to the coupling part 12 rotates with the same direction rotation of the setting wheel 8.

Figure 11A:
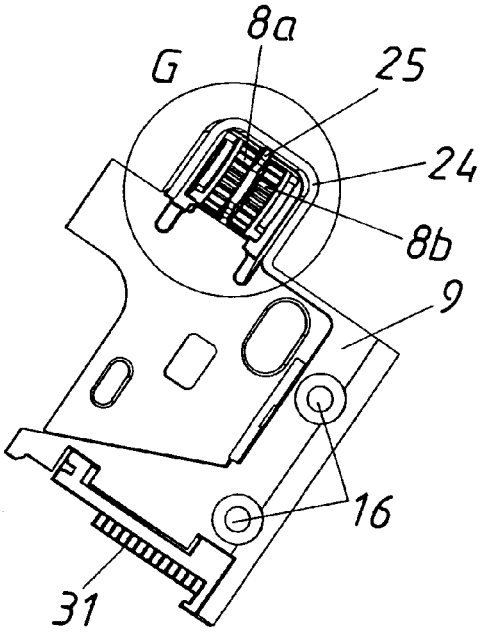
FIGS. 11*a* to *c* are perspective views of the fastening part of the device, as well as a detailed view thereof.

FIG. 11*a* shows a perspective view of the fastening part 9, on which a setting wheel 8 consisting of two halves 8*a*, 8*b* is rotatably mounted on a web 25 within a housing 24. The majority of the fastening part 9 is designed in the form of an installation plate. The holes 16 by which the fastening part 9 can be fastened to the bottom of the drawer 2*b* can be recognized.

Figure 11B:
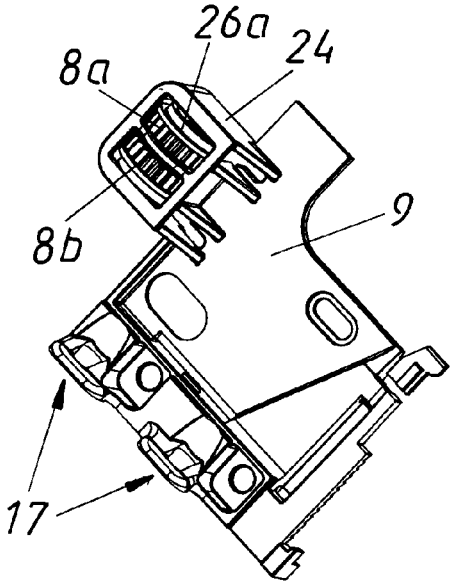

FIG. 11*b* shows a perspective view of the fastening part 9 with rotatably mounted setting wheel 8 from a different angle of observation. In this case, the holes 17 by which the fastening plate 9 can be fastened to the front faceplate 2*a* can be recognized.

Figure 11C:
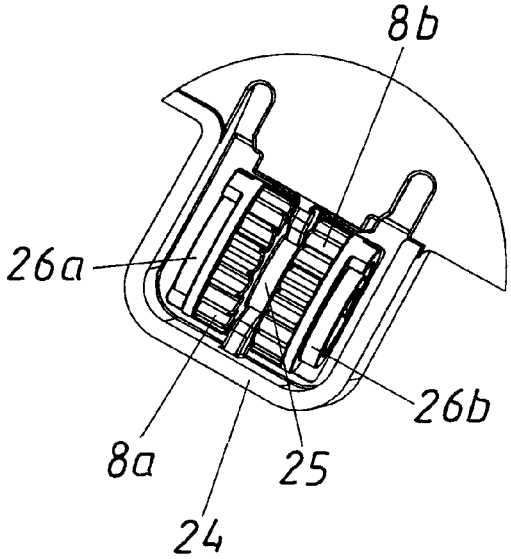

FIG. 11*c* shows in a detailed view the section identified by letter G in FIG. 11*a*. The spiral discs 26*a*, 26*b* in the form of helical-shaped projections arranged on the front sides of the setting wheel 8 can be recognized. The two halves of the setting wheel 8*a*, 8*b* have respectively an outer toothed section, so that the setting wheel 8 can be actuated more easily. In FIG. 11*b* it can be seen that one part of the setting wheel projects from the housing 24. This projecting or protruding region serves as an actuating region of the setting wheel. The two halves 8*a*, 8*b* are connected to one another in a rotation-resistant manner and are rotatably mounted on a web 25.

Figure 12A:
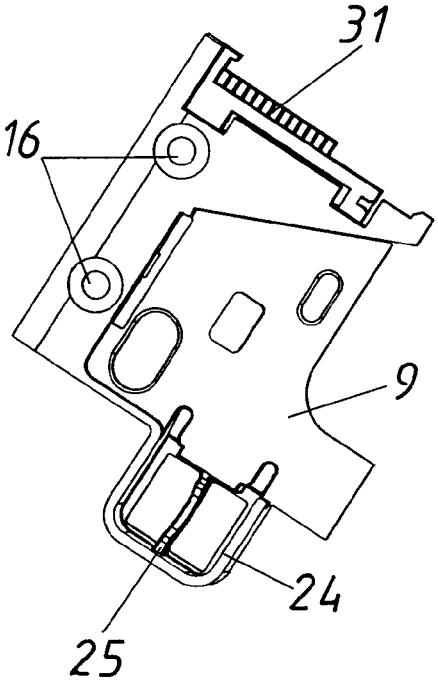
FIGS. 12*a* to *c* are perspective views of the fastening part and of the setting wheel in the separated state, as well as an exploded representation of the setting wheel.

FIG. 12*a* shows a perspective view of the fastening part 9 without the setting wheel 8. In particular, the web 25 on which the setting wheel 8 is rotatably mounted can be seen.

Figure 12B:
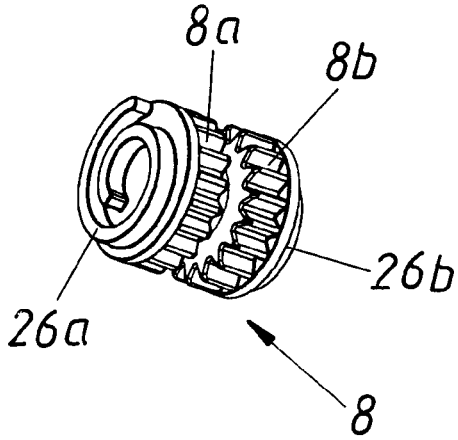
Figure 12C:
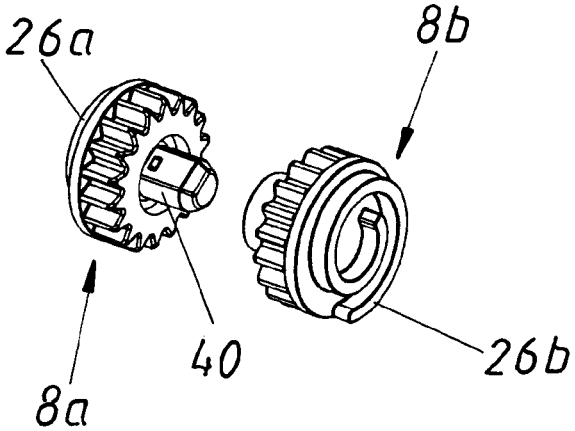

FIG. 12*b* shows a perspective view of the setting wheel 8 consisting of the two halves 8*a*, 8*b*. The spiral disc 26*a*, which is configured in the form of helical-shaped projections, can be recognized particularly easily. The spiral disc 26*b* arranged on the second half 8*b* is formed as a mirror image.

FIG. 12*b* shows an exploded representation of the setting wheel 8. The two halves 8*a*, 8*b* can be connected to one another in a rotation-resistant manner, whereby the rotation-resistant connection can be realized with means known per se in the prior art. For example, a catch-type connection or a snap-fit connection is conceivable. Thus, it can be envisaged to arrange on one half a bolt 40, which engages in a rotation-resistant manner via a recess or bearing position of the web 25 in a counter-means arranged on the other half of the setting wheel 8.

The invention claimed is:

1. A coupling device for detachably coupling a drawer to an extendable rail of a pull-out guide, said coupling device comprising:

a fastening part to be fastened to the drawer;

a coupling part to be coupled to the extendable rail; and an adjustment device configured to adjust a position of said fastening part relative to said coupling part in a lateral direction with respect to a longitudinal axis of the extendable rail by linearly moving said fastening part relative to said coupling part so as to thereby adjust a position of the drawer relative to the extendable rail in the lateral direction, said adjustment device including:

a setting wheel having a circumferential actuating region and output drive portions on opposite sides thereof, said setting wheel being rotatably mounted to a first one of said coupling part or said fastening part; and at least two axially spaced transmission devices mounted to a second one of said coupling part or said fastening part, said second one being different than said first one, said at least two transmission devices being configured to convert a rotational movement of said setting wheel into a linear movement of said fastening part relative to said coupling part for adjusting the position of said fastening part relative to said coupling part in the lateral direction.

2. The coupling device according to claim 1, wherein said adjustment device is self-locking.

3. The coupling device according to claim 1, wherein said setting wheel comprises two half side portions, each of said half side portions engaging with a one of said at least two transmission devices.

4. The coupling device according to claim 3, wherein a front side of each of said two half side portions of said setting wheel composes a respective one of said output drive portions and is formed as a spiral disc engaging a respective one of said at least two transmission devices for converting the rotational movement of said setting wheel into the linear movement.

5. The coupling device according to claim 1, wherein said setting wheel is rotatably mounted on said fastening part, said at least two transmission devices being mounted on said coupling part, said at least two transmission devices comprising at least two lugs each having a portion formed thereon configured to convert the rotational movement of said setting wheel into the linear movement of said fastening part relative to said coupling part.

6. The coupling device according to claim 5, wherein said portion formed on each of said at least two lugs is a toothed strip portion.

7. The coupling device according to claim 1, wherein said setting wheel is rotatably mounted on said coupling part, said at least two transmission devices being mounted on said fastening part, said at least two transmission devices comprising at least two lugs each having a portion formed thereon configured to convert the rotational movement of said setting wheel into the linear movement of said fastening part relative to said coupling part.

8. The coupling device according to claim 7, wherein said portion formed on each of said at least two lugs is a toothed strip portion.

9. The coupling device according to claim 1, wherein at least one of said at least two transmission devices comprises toothed strips on said second one of said coupling part or said fastening part.

10. The coupling device according to claim 1, wherein said setting wheel includes two connected portions each having a respective one of said output drive portions configured to engage a respective one of said at least two transmission devices for converting the rotational movement of said setting wheel into the linear movement of said fastening part relative to said coupling part, said two connected portions being non-rotatably connected to one another.

11. The coupling device according to claim 1, further comprising a housing part having an opening through which projects said actuating region of said setting wheel for allowing rotation of said setting wheel.

12. The coupling device according to claim 1, wherein said setting wheel is rotatably mounted so as to rotate about an axis substantially parallel to a movement direction of the drawer.

13. The coupling device according to claim 1, wherein said actuating region of said setting wheel is configured to allow rotation of said setting wheel, said at least two transmission devices of said adjustment device being configured to convert a movement of said actuating region of said setting wheel in an adjusting direction into the linear movement of said fastening part relative to said coupling part in the adjusting direction.

14. A coupling apparatus for detachably coupling a drawer to extendable rails of a pull-out guide, the extendable rails being arranged on opposite sides of a furniture carcass, said coupling apparatus including:

a first coupling device according to claim 1 for detachably coupling the drawer to a first rail of the extendable rails; and a second coupling device for detachably coupling the drawer to a second rail of the extendable rails, said second coupling device including:

a second fastening part to be fastened to the drawer; and a second coupling part to be coupled to the second rail, said second fastening part and said second coupling part being configured to linearly move relative to one another corresponding to a relative positional displacement of said fastening part and said coupling part of said first coupling device.

15. The coupling apparatus according to claim 14, wherein said second coupling device further includes a second adjustment device for adjusting a position of the drawer connected to the second rail in the lateral direction relative to the second rail, said second adjustment device including:

a second setting wheel rotatably mounted to a first one of said second coupling part or said second fastening part; and at least two axially spaced second transmission devices mounted to a second one of said second coupling part or said second fastening part, said second one being different than said first one, said at least two second transmission devices being configured to convert a rotational movement of said second setting wheel into a linear movement of said second fastening part relative to said second coupling part for adjusting a position of said second fastening part relative to said second coupling part in the lateral direction.

16. The coupling device set according to claim 15, wherein said at least two second transmission devices of said adjustment device are configured to convert a movement of said second setting wheel in an adjusting direction into the linear movement of said second fastening part relative to said second coupling part in the adjusting direction.

17. The coupling device set according to claim 14, wherein said second adjustment device is self-locking.

18. A drawer comprising:

a side wall;

a rear wall;

a front wall;

a bottom wall;

a pull-out guide attached to at least one of said side wall, said rear wall, said front wall, and said bottom wall; and said coupling device according to claim 1 fastened to at least one of said side wall, said rear wall, said front wall, and said bottom wall.

19. An item of furniture comprising:

a furniture body; and said drawer according to claim 18 mounted in said furniture body.

20. The coupling device according to claim 1, wherein said setting wheel has a cylindrically-shaped body, said circumferential actuating region being formed on a circumference of said cylindrically-shaped body, and said output drive portions being located on opposite axial ends of said cylindrically-shaped body.

* * * * *